US006458066B1

(12) United States Patent
Breton et al.

(10) Patent No.: US 6,458,066 B1
(45) Date of Patent: Oct. 1, 2002

(54) LINEAR FOLDING DEVICE AND METHOD

(75) Inventors: Richard Edward Breton, Rochester, NH (US); Joseph Adrian St. Ours, Lee, NH (US); Jatinder Singh Sappal, Dover, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/469,474

(22) Filed: Dec. 22, 1999

(51) Int. Cl.[7] ..... B31F 1/00
(52) U.S. Cl. ..... 493/423; 493/419
(58) Field of Search ..... 493/423, 416, 493/419, 441

(56) References Cited

U.S. PATENT DOCUMENTS 2,072,790 A * 3/1937 Apitzsch et al. ..... 493/423
3,961,783 A * 6/1976 Beaudoin ..... 270/66
4,747,817 A * 5/1988 Newsome ..... 493/438
5,030,193 A 7/1991 Breton et al. ..... 493/458
5,458,557 A 10/1995 Bladie et al. ..... 493/444

FOREIGN PATENT DOCUMENTS

DE 19725610 12/1998

* cited by examiner

*Primary Examiner*—John Paradiso
(74) *Attorney, Agent, or Firm*—Davidson, Davidson & Kappel, LLC

(57) ABSTRACT

A signature folding device includes a rotating belt and a plurality of blades attached to the belt, each of the plurality of blades contacting one of the signatures over an entire length of the one signature at a same time. Also disclosed is a method for folding a signature comprising transporting the signature on a fold table having a gap, the signature moving in a transport direction and forming a plane. A folding blade having a blade edge is moved in a direction both perpendicular and parallel to the transport direction, the blade edge being parallel to the plane upon contact with the signature, so as to pass through the gap and fold the signature.

13 Claims, 4 Drawing Sheets

LINEAR FOLDING DEVICE AND METHOD

BACKGROUND OF THE INVENTION

1. Field of the Invention

The present invention relates generally to folders of printing presses and more particularly to a device and method for folding a signature of printed material.

2. Background Information

Web printing presses print a continuous web of material, such as paper. The continuous web is then processed in a folder of the printing press. Folders can provide for particular desired folds in a finished printed product. A cutting unit is typically included to cut the web into individual signatures. Folds often need to be provided both to the web and the signatures which are cut from the web.

U.S. Pat. No. 5,458,557 purports to disclose a quarter fold folding device. A tucking blade is suspended by two opposite ends from two pivots, which are connected to rotationally-driven connecting rods. The blade thus moves up and down to tuck a signature between two cylinders so as to create a quarter fold. This device is complicated and requires complex gearing.

U.S. Pat. No. 5,030,193 purports to disclose a folder apparatus which includes a first folder assembly which forms a first fold in a web of sheet material along the path of movement of the sheet material. This first fold is performed by pulling the web over a triangular-shaped stationary folder board and feeding the web through a pair of nip rollers to set the fold. The web is then cut by a cutting cylinder to form signatures, the signatures then being carried by a tucking cylinder to a jaw cylinder. A tucking blade of the tucking cylinder pushed the signature into a set of jaws of the jaw cylinder to create the second fold, which is transverse to the first fold. The signatures are then sent to a third folder assembly having an array of tapes which grip the signatures and move them through the third folder assembly. The array of tapes maintain a straight direction within the third folder assembly. However, two stationary formers at the sides of the tapes accept the sides of the signature as the signature enters the third folder assembly. These formers then converge at an angle to the tapes, so as to force the outer edge portions of the signature upwardly, thereby forming the fold of the third folder assembly.

The first folder assembly of the above-cited patent has the disadvantage that the folder assembly cannot be used to fold a stream of individual signatures, since a continuous web must be pulled over the stationary former board. The second folder assembly has the disadvantage that many moving parts are required, it is complicated, and may not operate fast enough to support full press speeds for various types of printing presses. The third folder assembly has the disadvantage that the design is complicated and requires a large number of belts of different length.

In addition, known chopper folding mechanisms often require more than one chopper folder mechanism to support a single printing press running at full speed. The signature stream thus often must be split and decelerated, which requires auxiliary devices such as diverters, slow down sections and integrators. These auxiliary devices increase the risk of fold inaccuracies, as the signatures must interact with each device and still maintain proper position.

German Patent Publication No. 197 25 610 discloses a pre-folding device in which a plurality of folding blade segments next to each other are attached to a belt. The belt slopes downward as a signature enters the pre-fold area. The blade segments, due to the slope in the belt, gradually fold the signature, so that a longitudinal fold is applied to the signature from its leading edge to its tail edge gradually.

This gradual fold may cause quality problems, such as creasing of the signature as the fold develops.

BRIEF SUMMARY OF THE INVENTION

An object of the present invention is to provide for a device and method for folding signatures whereby the speed of individual signatures need not be reduced significantly to perform a fold in the signatures and whereby the quality of the fold is improved. An additional or alternative object of the present invention is to provide for a simplified device or method for folding signatures.

The present invention provides a signature folding device for folding signatures, the device including a rotating belt and a plurality of blades, each blade for creating a fold in a signature. The plurality of blades are attached to the belt, and each of the plurality of blades contacts one of the signatures over an entire length of the one signature at a same time.

With the device of the present invention, the longitudinal fold is applied in one step, thereby reducing the possibility of creasing.

Preferably, each blade is segmented.

Preferably, each of the plurality of segmented blades includes blade segments having a blade portion and a base portion. Each blade advantageously may begin with a segment with a shorter blade portion, with the next blade portions being progressively longer. This sloped arrangement permits the blades to contact the signatures at an advantageous angle.

Preferably, the segmented blades are spaced apart from each other over the belt. The blades may be spaced at a pitch length that corresponds to the pitch of the signatures entering the device.

The belt is located next to a fold table, so that the blade may pass through the fold table. Advantageously, a pair of breaker rolls and belts may be located on an other side of the fold table to aid in setting the fold. The fold table preferably has a plurality of driven tapes for transporting the signature or book.

The belt preferably is of such a length and shape that at least two of the segmented blades may be located on a side of the belt facing the table. This construction permits for the folding to take place over a longer distance, thus allowing the folding process to be more gentle on the signature, even at full speed. The belt advantageously may be a timing belt, and be rotated by a pair of toothed wheels. At least one of the toothed wheels may drive the belt and be attached to a drive mechanism for the tapes of the fold table. The belt preferably is arranged at an angle to a surface plane of the fold table, the angle preferably being less than 30 degrees.

The present invention also provides a method for folding a signature which includes transporting the signature on a fold table having a gap, with the signature forming a plane and moving in a transport direction. A blade having a blade edge is moved in a direction both perpendicular and parallel to the transport direction, with the blade edge being parallel to the plane, so as to move through the gap, thus folding the signature.

The plurality of blades thus are moved in the transport direction at an angle to a surface plane of the fold table. The angle preferably is less than 30 degrees.

The plurality of blades may be arranged in sets, preferably so that at least two sets of blades are acting on signatures at the same time. This arrangement aids in increasing folding speed.

A belt may carry the blades and may be a timing belt, timed to move at a similar speed as the signatures on the fold table. However, the belt may also be angled at an angle A toward a surface plane of the fold table. In that case, it may be advantageous to run the belt at a speed approximately equal to the speed of the signatures divided by the cosine of A, so that the speed of the blades along the surface plane of fold table is similar to that of the signatures.

The present method and device allow for high speed folding of individual signatures in an uncomplicated manner. Moreover, the chopping force on the signature is reduced significantly compared to a direct vertical chopping mechanism due to the fact that the signature may be acted on by the chopper blade during a longer time than for a direct vertical chopping mechanism. The folder is also insensitive to signature length, although some slowdown on the order of 3% to 18% may be required when the cutoff changes. Advantageously, the product does not change direction during folding.

BRIEF DESCRIPTION OF THE DRAWINGS

An embodiment of the present invention is described below by reference to the following drawings, in which.

DETAILED DESCRIPTION

Figure 1:
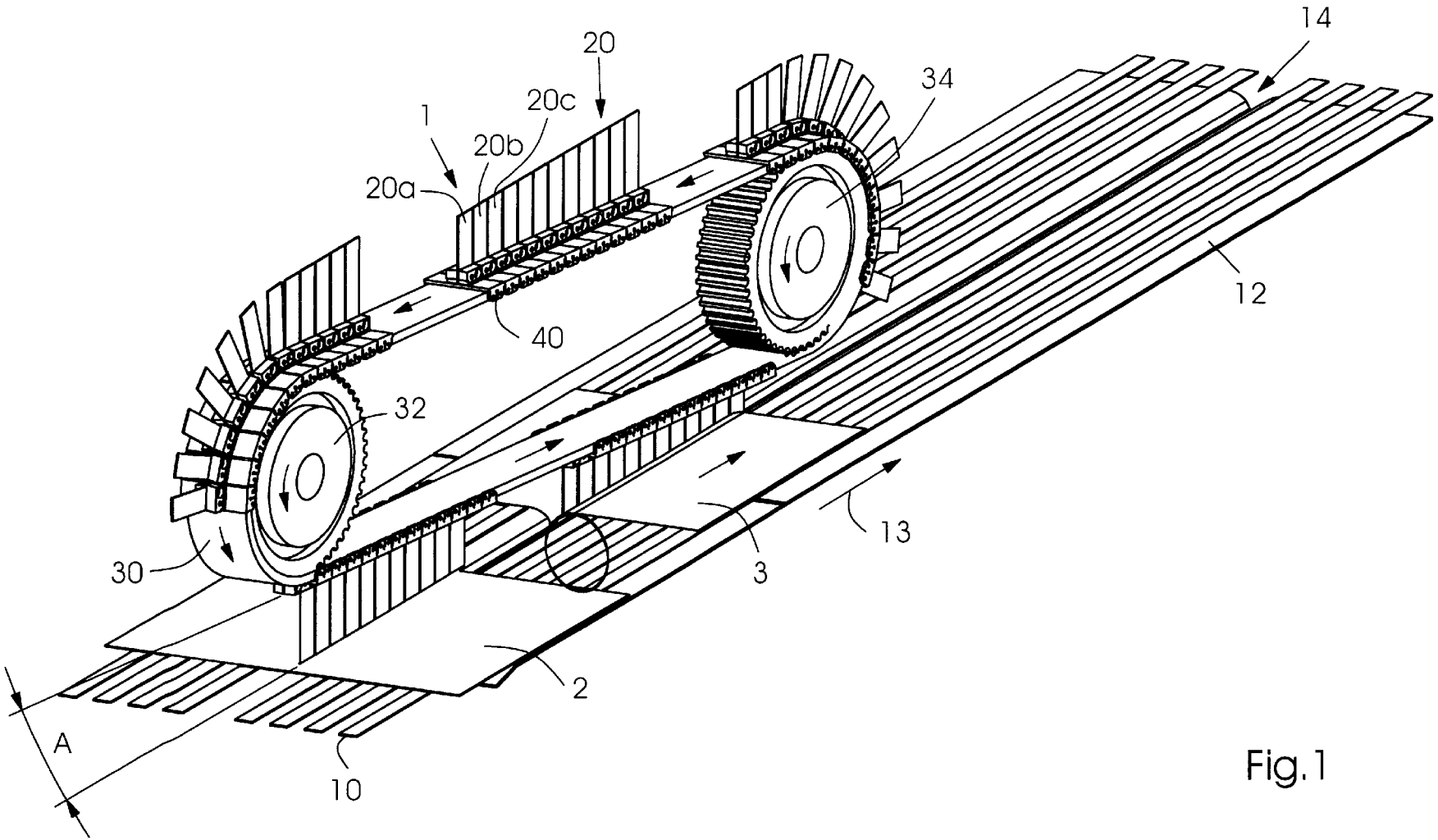
FIG. 1 shows a perspective view of the device of the present invention.

FIG. 1 shows a perspective view of the a folding device 1 for folding signatures 2 and 3. Signatures 2 and 3 are transported by driven tapes 10 along a surface of a folding table 12 in a transport direction 13. Upper tapes drive the top of signatures 2, 3 but are not shown for clarity. Folding table 12 has a gap 14 which extends in the same direction as transport direction 13. Folding device 1 includes a plurality of segmented blades 20 each having individual-blade segments 20*a*, 20*b*, 20*c*, etc. The segments 20*a*, 20*b*, 20*c* are attached fixedly to a belt 30 having inner teeth so as to form a timing belt. The belt 30 is driven by at least one of two toothed wheels 32 and 34, and is arranged at an angle A to the surface plane of folding table 12.

Each segment 20*a*, 20*b*, 20*c* of blade 20 includes a base portion 40, which preferably is attached to belt 30 by mounting pins. The base portion 40 is thus prevented from sliding on belt 30.

The base portion 40 holds a blade portion 42. Two removable bolts or screws can be used to hold the blade portion 42, so that the blade portion 42 may be easily replaced if it is damaged. The base portion 40 and the blade portion 42 may be of a spring steel construction. In order to reduce weight, these components also may be made from lightweight composite or plastic materials.

Figure 2:
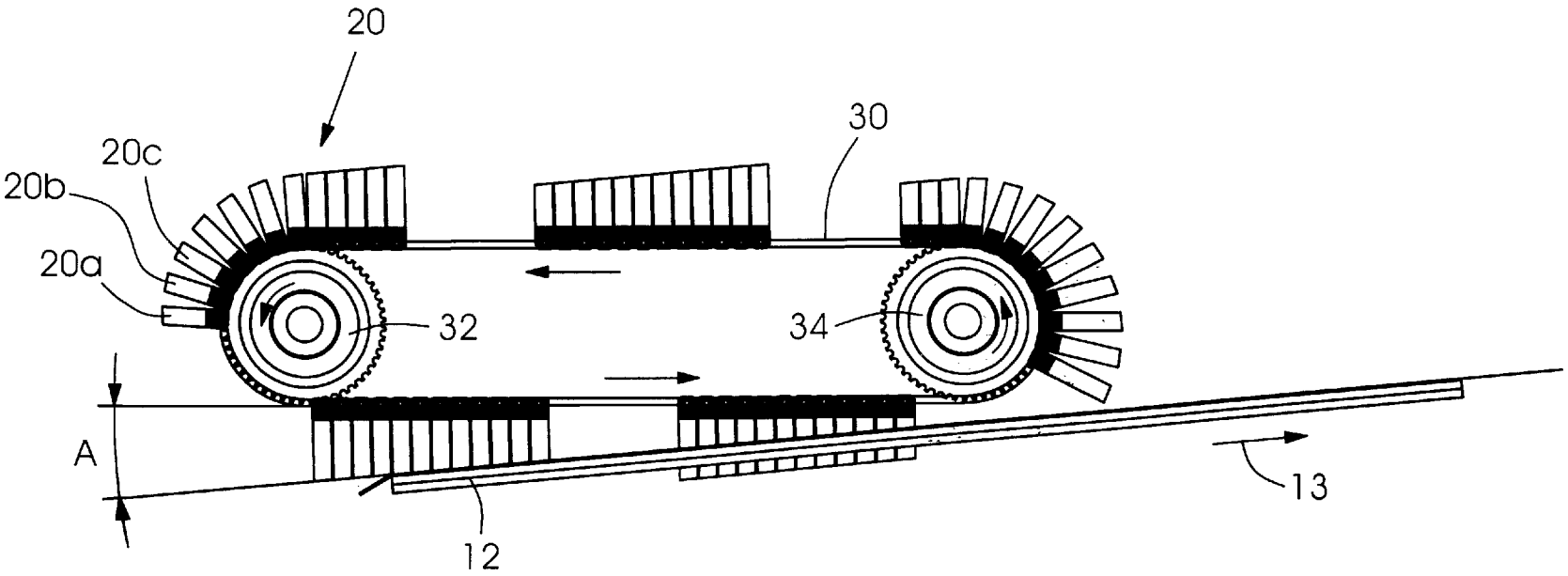
FIG. 2 shows a side view of the device of the present invention.

FIG. 2 shows a side view of the device of FIG. 1, with the blade 20 shown in FIG. 1 having been rotated by belt 30. Because of the segmented nature of blade 20, the blade segments 20*a*, 20*b* and 20*c* are free to separate as they pass over wheel 32. Before the segmented blades 20 contact the surface of the signature, the segments have realigned so as to present themselves as a continuous blade edge to the surface of the signature. The surface of the signature thus forms a plane, and the continuous blade edge is parallel to the plane.

Blade segments 20*a*, 20*b*, 20*c*, etc. preferably become progressively longer, and have angled edges, so that the blade edge is sloped. The angle between belt 30 as belt 30 runs straight and the sloped blade edge preferably is equal to the angle A between belt 30 as belt 30 runs straight and the surface plane of fold table 12. Thus the blade edge presents itself as parallel to the fold table as it passes through gap 14 (FIG. 1) in direction 13.

Figure 3:
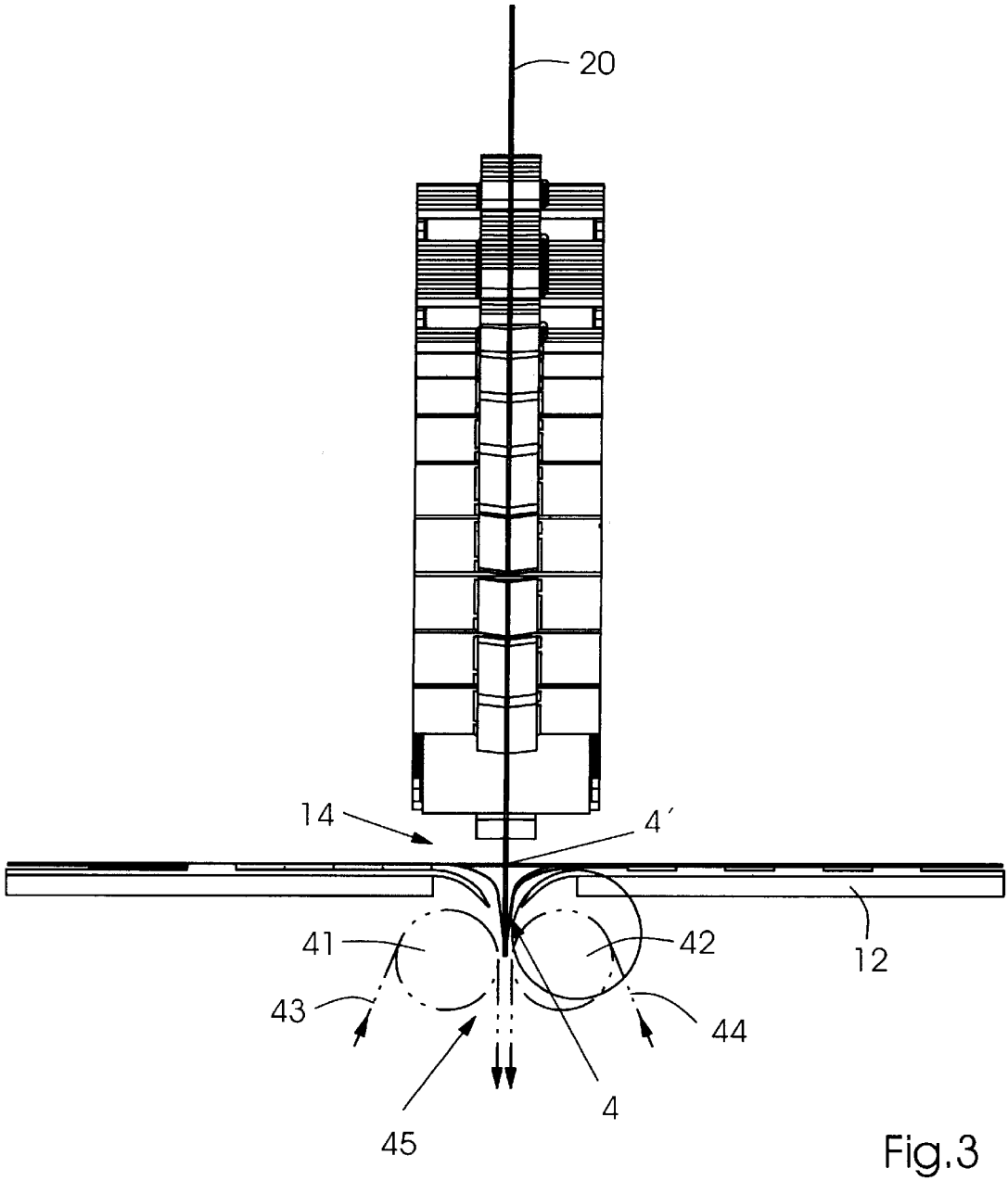
FIG. 3 shows an end view of the device of the present invention.

FIG. 3 shows an end view of the device of the present invention. A signature 4 is being pushed by a segmented blade through gap 14 of fold table 12. The signature 4 before contact with the blade was at location 4'. As signature 4 continues to move forward (out of the page as viewed in FIG. 3), signature 4 is accepted by a nip 45 formed between two breaker rolls 41 and 42 having respective belts 43 and 44, shown schematically in FIG. 3 and in more detail in FIG. 4. Nip 45 thus sets the fold in signature 4 and can transport the signature away from fold table 12, to be accepted for example, by a deceleration unit.

Belt 30 preferably is driven at a speed slightly faster than that of the signature as the signature enters the fold table. This increased speed is to compensate for the angle A, so that the speed of the blades in a direction parallel to the product flow direction is similar. Thus the belt preferably may be driven at a speed approximately equal to the speed of the signatures as they enter the fold table, divided by the cosine of A.

Figure 4:
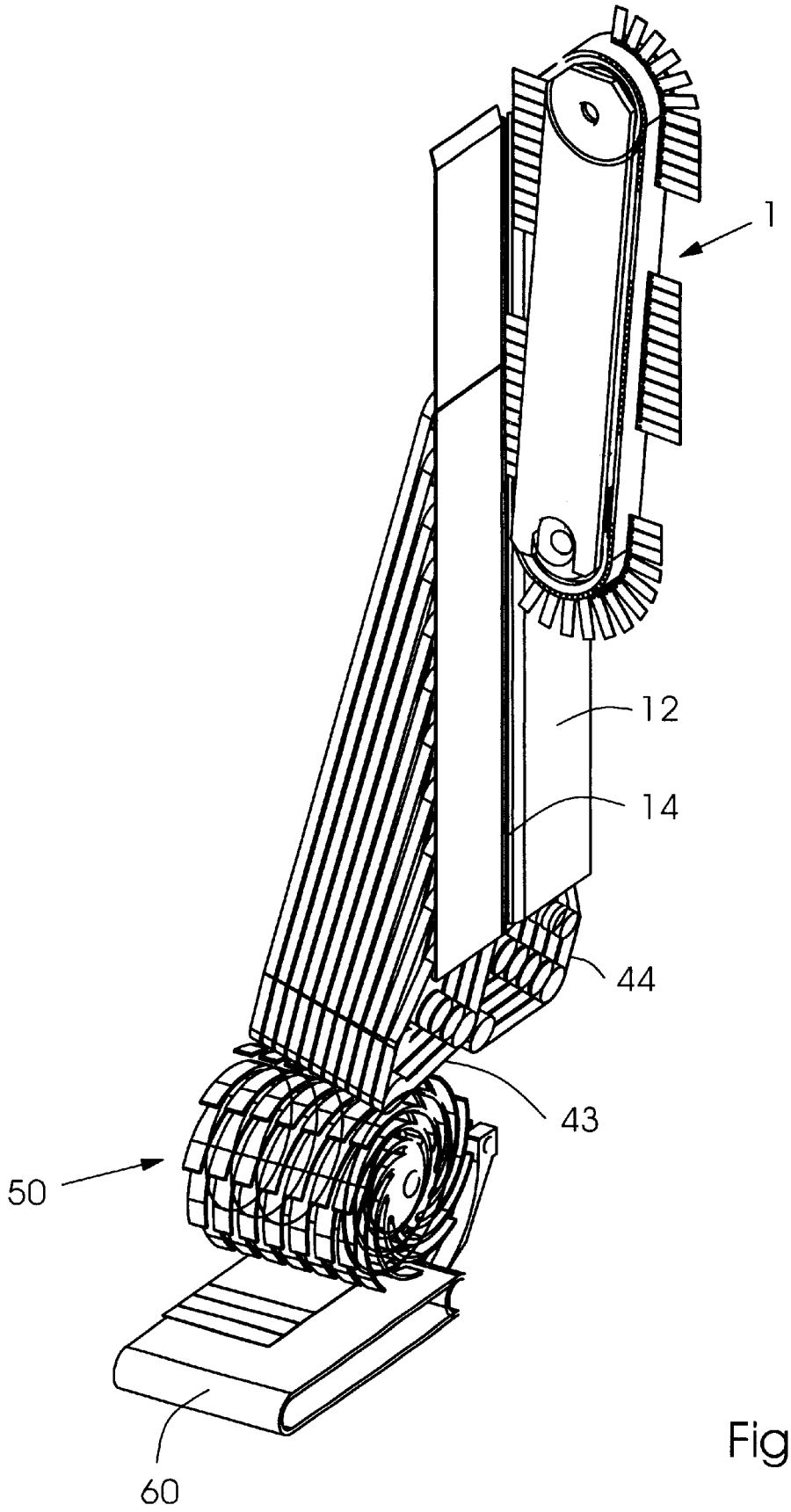
FIG. 4 shows a possible utilization of the device of the present invention in a folder apparatus.

FIG. 4 shows the use of the device of the present invention in a folder apparatus. Signatures to be folded may be held by tapes (not shown) on both sides, so that the signatures are firmly held so as not to be effected by gravity. As the signatures pass though the gap 14 in fold table 12, the signatures are grasped by breaker belts 43 and 44, which transport the signatures to a deceleration device 50 which can decelerate the folded signatures and pass them to a further conveyance device 60.

While the present invention has been shown with segmented blades, it may also be possible to have single blades rotatingly supported on a belt to present a continuous blade surface to the signature.

What is claimed is:

1. A signature folding device comprising:

a rotating belt; and a plurality of blades attached to the belt, each of the plurality of blades contacting one of the signatures over an entire length of the one signature at a same time.

2. The signature folding device as recited in claim 1 wherein each of the plurality of blades is segmented.

3. The signature folding device as recited in claim 1 further comprising a fold table, the belt being arranged between two drive wheels, so as to have a straight section opposite the fold table.

4. The signature folding device as recited in claim 3 wherein at least two of the plurality of segmented blades fit within the straight section of the belt.

5. The signature folding device as recited in claim 3 wherein the straight section forms an angle with a surface plane of the fold table.

6. The signature folding device as recited in claim 5 wherein at least one of the segmented blades includes a sloped blade edge.

7. The signature folding device as recited in claim 5 wherein the angle is less than 30 degrees.

8. The signature folding device as recited in claim 1 further comprising a fold table next to the belt, the fold table having a gap.

9. The signature folding device as recited in claim 1 wherein at least one of the blades includes a sloped blade edge.

10. The signature folding device as recited in claim 1 wherein each blade includes at least three blade segments.

11. The signature folding device as recited in claim 1 wherein the belt is a timing belt.

12. The signature folding device as recited in claim 1 further comprising a fold table having a gap for supporting the one signature and breaker belts located next to the fold table on a side opposite the belt for accepting the one signature after the one signature passes through the gap.

13. A signature folding device comprising:

a rotating belt; and a plurality of blades attached to the belt, each of the plurality of blades for folding one signature, the one signature forming a plane, each of the blades having a blade edge parallel to the plane upon contact with the one signature.

* * * * *